United States Patent [19]

Boe

[11] Patent Number: 4,714,914

[45] Date of Patent: Dec. 22, 1987

[54] LIQUID IMMERSION ALARM

[75] Inventor: Richard A. Boe, Keyport, Wash.

[73] Assignee: Automatic Safety Products, Mammoth Lakes, Calif.

[21] Appl. No.: 853,379

[22] Filed: Apr. 15, 1986

Related U.S. Application Data

[63] Continuation of Ser. No. 558,015, Dec. 5, 1983, abandoned.

[51] Int. Cl.[4] ..... G08B 23/00

[52] U.S. Cl. ..... 340/573; 340/620; 340/539; 200/61.04; 441/89

[58] Field of Search ..... 340/573, 539, 545, 620, 340/618, 604, 605; 441/80, 89; 200/61.04

[56] References Cited

U.S. PATENT DOCUMENTS

| | | | |
|---|---|---|---|
| 3,122,736 | 2/1964 | Weber | 340/604 X |
| 3,399,399 | 8/1968 | Apfelbaum | 340/620 X |
| 3,530,855 | 9/1970 | George | 340/693 X |
| 3,810,146 | 5/1974 | Lieb | 340/573 X |
| 4,127,847 | 11/1978 | Stifter | 340/530 |
| 4,216,468 | 8/1980 | Kaufmann | 340/620 |
| 4,305,143 | 12/1981 | Simms et al. | 340/573 X |
| 4,502,044 | 2/1985 | Farris et al. | 340/604 |
| 4,540,976 | 9/1985 | Wegrzn | 340/573 X |
| 4,603,327 | 7/1986 | Leonard et al. | 340/573 |

*Primary Examiner*—James L. Rowland
*Assistant Examiner*—Jeffery A. Hofsass
*Attorney, Agent, or Firm*—Poms, Smith, Lande & Rose

[57] ABSTRACT

A liquid immersion alarm is shown having a remote transmitter activated by a water immersion switch to generate an alarm signal. The alarm signal is received by a receiver that activates an alarm. Immersion of the transmitter and its immersion switch momentarily into water will not set off a false alarm due to a delay circuit associated with the transmitter. Once immersed, entrapped air will not interrupt the delay circuit from setting off the alarm due to a second delay circuit.

15 Claims, 9 Drawing Figures

LIQUID IMMERSION ALARM

This is a continuation of copending application Ser. No. 558,015 filed on Dec. 5, 1983, now abandoned.

BACKGROUND OF THE INVENTION

1. Field of the Invention

The present invention relates to a liquid immersion alarm and, more particularly, to an alarm which may be momentarily immersed in water without generating a false alarm signal and which may be immersed in water and subjected to momentary open circuits which might be caused by entrapped air without cancelling the delayed alarm signal.

2. Description of the Prior Art

It is known in the prior art to utilize a remote transmitter to generate a signal that can be received by a fixed receiver which, in turn, actuates a mechanical or electrical response to the received signal. An example of such a device is the remote garage door activator which transmits a signal to be a fixed receiver that energizes a motor for raising or lowering a garage door.

These commonly known transmitters and receivers lend themselves to the basic principles of the present invention in that they form the base from which this invention is constructed.

SUMMARY OF THE INVENTION

The present invention is designed for use in various safety applications where it is desired to warn of a liquid immersion. The liquid immersion alarm of the present invention is best suited for use by a seaman or sailor who would wear a transmitter upon a life-vest or other suitable article of clothing. The alarm includes a water activated switch which becomes conductive when immerged in salt water for closing a circuit and activating the transmitter. The signal thus transmitted is received by a suitable receiver located upon a vessel or sailboat which applies power to a relay for activating an alarm device, such as a horn or siren.

One problem in utilizing a transmitter with a water activated switch when working upon a seagoing vessel is that the wearer is liable to be exposed to wave action which might accidentally set off the alarm. Accordingly, the present invention provides a delay circuit which prevents momentary contacts with conductive water or other liquids from activating the transmitter and generating a false alarm.

Another problem with the design of a liquid activated switch is that a simple delay circuit could be erroneously turned off by the presence of air or other gases after the liquid activated switch is initially immersed. Thus, another object of this invention is to provide a second delay circuit which prevents the presence of air or other gases from erroneously interrupting the delay after the liquid activated switch has been immersed. The second delay circuit also prevents repeated, transient liquid contact from generating an alarm condition.

The present invention may be worn by seaman and sailor but is also applicable in other situations, including use by toddlers within their own backyard when that backyard includes a swimming pool. Further, the liquid immersion alarm can be used in mines and quarries where the presence of ground water or seepage could momentarily trigger a false alarm without the delay circuit incorporated into the liquid immersion alarm. Should the mine or quarry in which the alarm is used be subjected to pump failure or should the minors strike a pocket of underground water during excavation, the resulting inundation of the liquid activated switch would trigger an alarm signal at its remote location to sound an alarm at a surface receiver.

BRIEF DESCRIPTION OF THE DRAWINGS

Other advantages of the present invention will become apparent to those skilled in the art after consideration of the following specification and drawings, wherein.

DESCRIPTION OF THE PREFERRED EMBODIMENT

Figure 1:
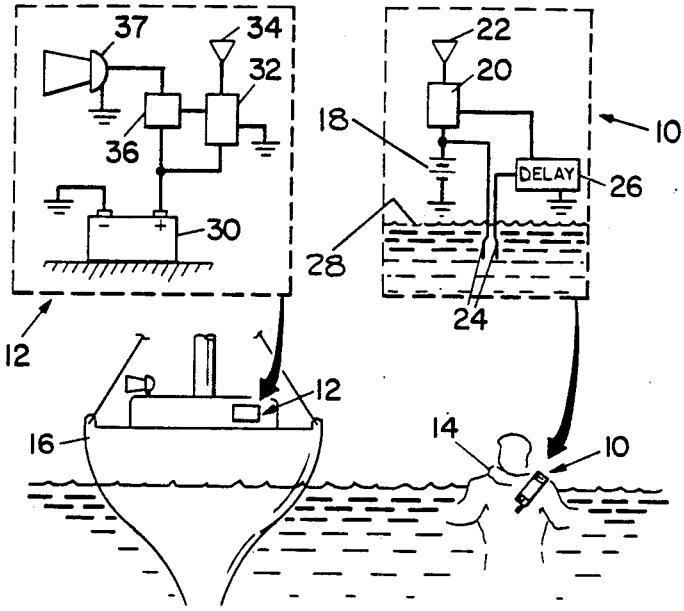
FIG. 1 is a schematic diagram illustrating the liquid immersion alarm of the present invention.

The liquid immersion alarm of the present invention includes a transmitter 10 and a receiver 12, FIG. 1. The transmitter is portable and specially designed to be mounted upon a strap of a lifevest 14 or other suitable wearing apparel. The transmitter 10 operates remotely from the receiver 12 which is permanently mounted at a base station such as a sailboat 16, power boat, kitchen (when used by an infant), or security shack (when used in a mine or quarry).

As shown in FIG. 1, the transmitter 10 generally includes a power source or battery 18, a transmitter circuit 20, an antenna 22, and a liquid activated switch 24 which connects the positive terminal of the battery 18 to a delay circuit 26 for activating the transmitter circuit 20 by connecting circuit 20 to ground through circuit 26 after the switch 24 has been immersed in a liquid 28 for a predetermined period of time. An alarm signal is then generated for transmission by antenna 22 when the transmitter is activated.

The receiver 12 includes a second power source or battery 30 whose positive terminal is connected to ground through a receiver circuit 32 which maintains the receiver in an on condition ready to receive the transmitted alarm signal from transmitter 10 via a receiving antenna 34. The receiver circuit 32 then connects a power relay 36 to ground which, in turn, connects the positive terminal of battery 30 to an alarm device, such as a horn 37.

In operation, the liquid immersion alarm described by the block diagrams of FIG. 1, functions when the wearer of the transmitter 10 falls overboard from a sailboat 16, for example. Once the liquid activated switch 24 has been immersed in water, there is enough conductivity between the separated conductors to permit a current flow from battery 18 to the delay circuit 26. The flow starts the delay circuit 26 which, after a predetermined time, connects the transmitter circuit 20 to ground through the delay circuit 26 to generate an alarm signal from antenna 22.

But for the presence of the delay circuit 26, the transmitter circuit shown in FIG. 1 would be energized whenever the liquid activated switch 24 was momentarily immersed in water. This could occur whenever a seaman wearing the device was exposed to a wave, a wave splash, or its spray. To prevent these false alarms, the delay circuit 26 must be energized for a predetermined period of time before it connects the transmitter circuit 20 to ground. This delay circuit 26 is an important feature of the present invention.

Figure 2:
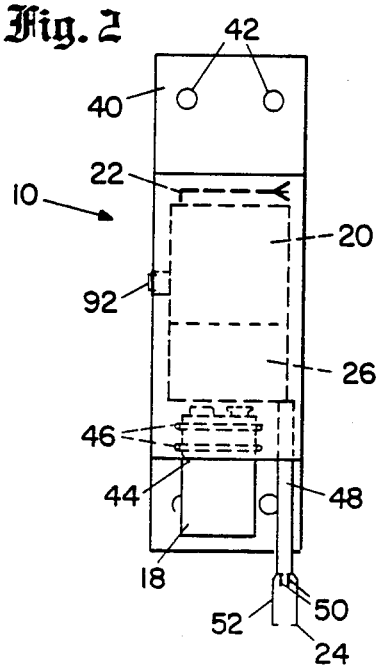
FIG. 2 is a front view of the liquid immersion alarm transmitter.
Figure 3:
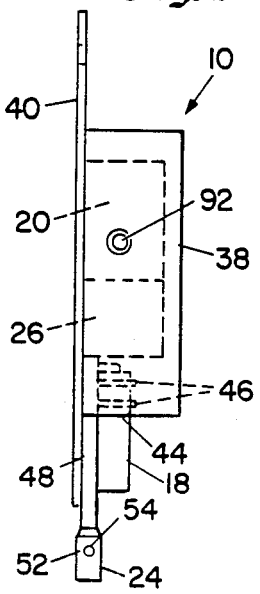
FIG. 3 is a side view of the transmitter shown in FIG. 2.

Referring now to FIGS. 2 and 3, the front and side views of the transmitter 10 of the liquid immersion alarm are shown in greater detail. The transmitter circuit 20 and delay circuit 26 are encapsulated within a watertight housing 38 which may be formed by a molded, closed cell polyurethene flexible foam of low dielectric constant. Attached to the base of housing 38, is a mounting strap, such as a woven nylon strap 40. The strap 40 may be provided with apertures 42 through which suitable fastening devices, such as thread or a safety pin may be passed to attach the transmitter 10 to the lifevest 14. In the preferred embodiment the antenna 22 is imbedded within the molded material which forms the housing 38 above the transmitter circuit 20.

The lower end of housing 38 is provided with an aperture 44 having grooves therein which receive a pair of O-rings 46, for example. The aperture 44 receives the battery 18 in a sealed arrangement wherein the elastomeric material of O-ring 46 engage the outer surface of the battery casing 18 to seal out the water into which the transmitter 10 is immersed. Alternately, the housing aperture 46 and battery 18 may be coated with an insoluble grease to prevent leakage.

Extending from the lower portion of housing 38 is a flexible tube or wire shield through which is passed a pair of conductive wires 50, FIG. 2. Shield 48 and conductors 50 are constructed from the insulated jacket of a two conductor wiring cable in the preferred embodiment. The cantilevered end of shield 48 is fitted with a cylindrical shield 52 whose lower-most end may be partially closed about the exposed conductors 50 therein. The mid-portion of shield 52 is provided with apertures 54 which, when inundated by water, permit the escape of gases entrapped therein to permit the conductive water to surround the exposed wires 50 and close the circuit therebetween. The wires 50 and shield 52 which form the liquid activated switch 24 will be described in greater detail hereinbelow with regard to FIG. 9.

The transmitter 10 shown in FIGS. 2 and 3 may be modified by reducing (or extending) the length of the shield 48 so that the shielded end 52 does not extend beyond battery 18. Further, it will be understood that the housing 38 may be extended to protect a larger portion of battery 18 and to enclose a substantial portion of the sield 52. Similarly, the antenna 22 may extend beyond housing 38 and be attached to the upper portion of strap 40.

Figure 4:
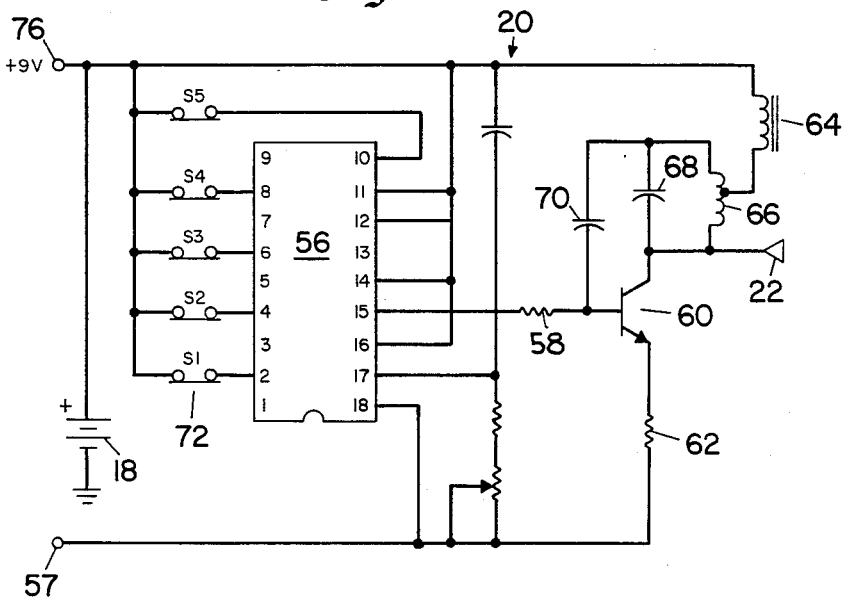
FIG. 4 is a schematic of the transmitter shown in FIGS. 2 and 3.

Referring now to FIG. 4, the transmitter circuit 20 is shown in greater detail including a digital oscillator 56 whose terminals 2, 4, 6, 8, 10, 11, 12, 14 and 16 are connected to the positive termianl of battery 18; while the terminal 18 of oscillator 56 is connected to a terminal 57. The output of the digital oscillator circuit 56 is connected by terminal 15 through a resistor 58 to the base of an NPN transistor 60 whose emitter is connected to terminal 57 via a resistor 62.

The positive terminal of battery 18 also connects an iron core inductor 64 to the center tap of an air core inductor 66 having one terminal connected to the collector of transistor 60 and its second terminal connected thereto via capacitor 68. The second terminal of inductor 66 is also connected to the base of transistor 60 via a second capacitor 70. In operation, the carrier frequency of the transmitter 20 is established by the tank circuit formed by inductors 64 and 66 in combination with capacitor 68 and 70 for transmnitting a carrier frequency from antenna 22 having a digital code determined by the output of the oscillator 56 and a plurality of single pole, single throw switches 72 connected in the input of oscillator 56. The negative terminal of battery 18 is connected to ground, while the positive terminal is connected to a second terminal 76.

Figure 5:
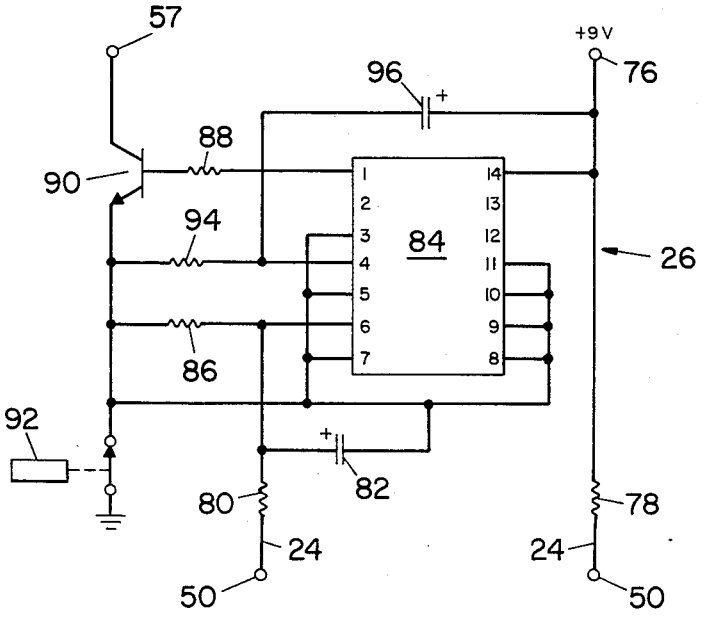
FIG. 5 is a schematic of the liquid activated timer and latch circuit used within the transmitter of FIGS. 2 and 3.

Referring now to FIG. 5, the delay circuit 26 is shown connected to the liquid activated switch 24 which consists of a pair of copper conductors 50 whose lower ends are exposed. One conductor 50 is connected via a resistor 78 to the termianl 76 and the positive terminal of battery 18. The other conductor 50 is connected via a resistor 80 to the positive electrode of a capacitor 82 and to the set terminal 6 of a D-type flip flop 84. The set terminal 6 of flip flop 84 is also connected via a bleed resistor 86 to ground. The second electrode of capacitor 82 and terminals 3, 5, 7, 8–11 of the D-type flip flop are all connected directly to ground; while its output terminal 1 is connected via a resistor 88 to the base of an NPN transistor 90 whose emitter is connected to ground and whose collector connects to terminal 57. The emitter of transistor 90 is also connected via a resistor 94 to the reset terminal 4 of flip flop 84. Connected to the junction between resistor 94 and reset terminal 4 is a capacitor 96 whose positive electrode is connected to the terminal 76. A reset switch 92 in the form of a single pole, single throw push switch connects the emitter of transistor 90 to ground.

In operation the immersion of the exposed conductors 50 in a conductive liquid, such as salt water, water found in most swimming pools and mineral enriched water found in mines or quarries, places a resistance between the contacts 50 (equal to approximately 40K ohms in seawater) which places a voltage build-up on capacitor 82. The increased voltage on capacitor 82 will rise over approximately a three second period to a level high enough to apply a positive going signal to the set terminal 6 of flip flop 84. This voltage build-up on capacitor 82 is prevented from being dumped to ground when the resistance between contact 50 is momentarily removed, due to the presence of entrapped gases or air bubbles, through the combination of the bleed resistor 86. That is, resistor 86 is approximately ten times larger than resistor 80 and allows some interruption of the resistive connection between contacts 50 without discharging the capacitor 82. Conversely, should a wave, a splash from a wave, or spray cause a momentary closure of the circuit between contacts 50, the resultant charge on capacitor 82 will be dumped to ground through resistor 86 to prevent the retention of an unwanted charge on capacitor 82. It will be seen that the resistor 86, in combination with resistor 80, must be large enough to prevent the drainage of a building charge on capacitor 82 when air bubbles interrupt the circuit between contacts 50, yet, small enough to permit the drainage of a charge caused by a wave or spray.

The set terminal 6 of flip flop 84 goes to logical high when the voltage on capacitor 82 reaches approximately one-half of the supply voltage of 9 V DC. The output of the flip flop at terminal 1 then drives the NPN transistor 90 to a conductive state to connect the terminal 57 of transmitter circuit 20 to ground and to energize that circuit 20 for generating an alarm signal which is transmitted by antenna 22 and received by antenna 34 and its associated receiver circuit 32.

The flip flop 84 is returned to the reset state by depression of the reset switch 92 which removes the ground connection from delay circuit 26 and transmitter circuit 20. The positive potential of battery 18 is applied through terminal 76 and capacitor 96 to increase the potential at the reset terminal 4 of flip flop 84 and to reset that flip flop as the push button switch 92 closes. After the push button switch 92 is closed, bleeder resistor 94 permits the input at terminal 4 to return to ground potential. The positive terminal 76 is connected to terminal 14 of flip flop 84 to supply enough power to the base of transister 90 through resistor 88 to retain the transistor 90 in a state ready for connecting the transmitter circuit 20 to ground once the flip flop 84 has been set by a positive signal at terminal 6.

As mentioned above, the probe 48 extends below the housing 38 and is provided with a shield 52 which prevents water from contacting the exposed conductors 50 unless the shield is immersed in water. Once immersed, the capacitor 82 begins to charge at a rate established by the combination of the resistors 80 and 86. The apertures 54 permit the escape of gases or air from the chamber formed by shield 52 once the chamber is immersed.

Figure 6:
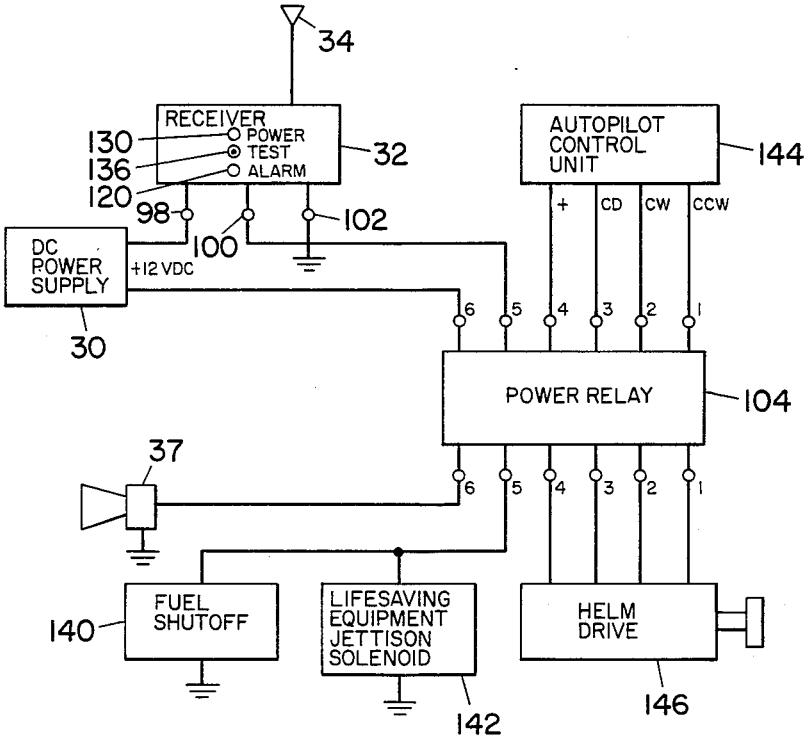
FIG. 6 is a schematic diagram of the liquid immersion alarm at its base station.

An alarm signal transmitted by antenna 22 is received by antenna 34 and its associated receiver circuit 32, FIG. 6. The receiver 32 includes three terminals 98, 100 and 102, wherein terminal 98 is connected to the positive terminal of a DC power supply, such as battery 30, and terminal 102 is connected to ground. Terminal 100 is connected to a power relay 104 at its input terminal 5. A second input terminal 6 of relay 104 is connected to the positive terminal of battery 30.

Figure 7:
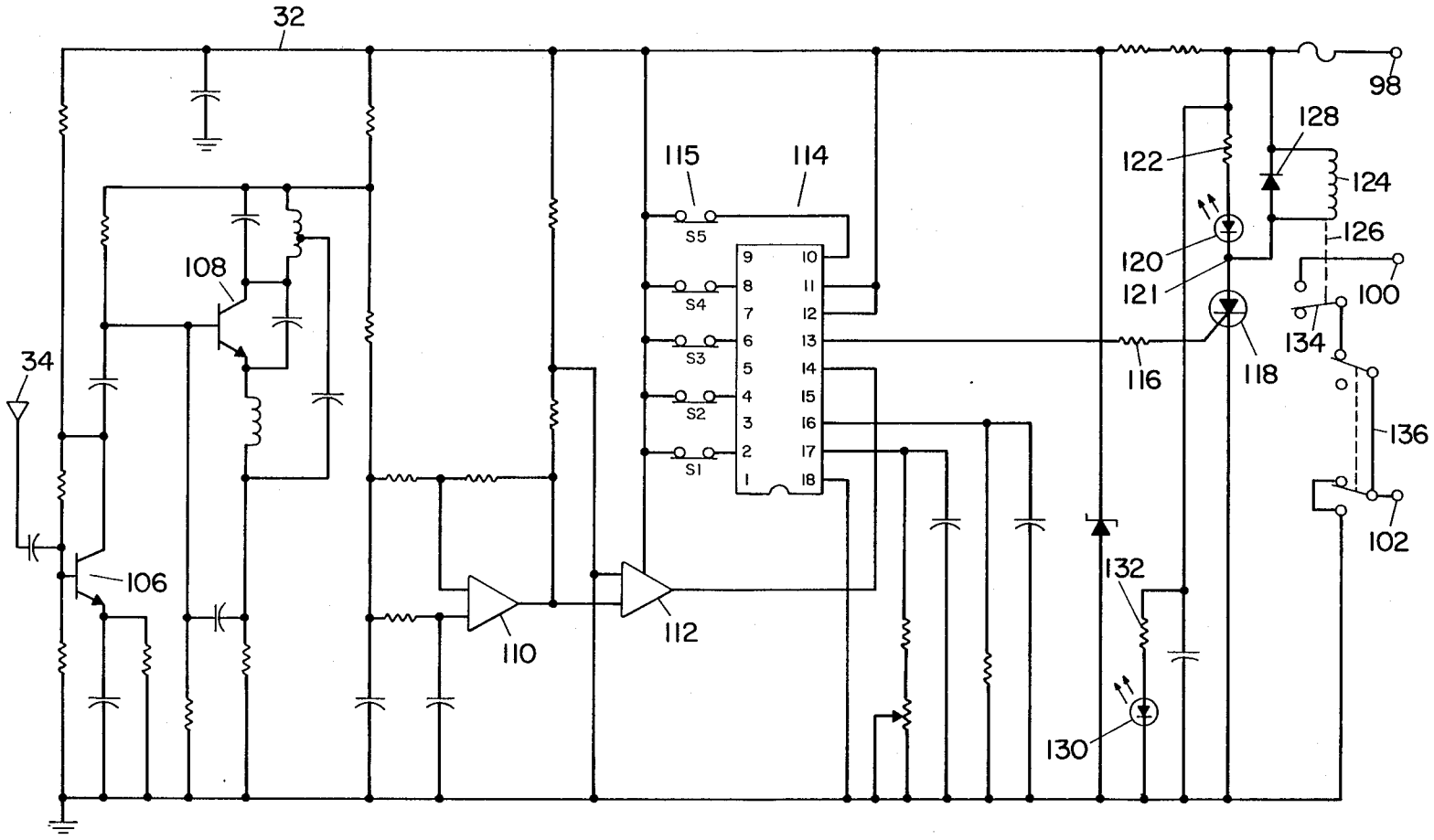
FIG. 7 is a schematic diagram of the receiver used by the alarm.

As seen in FIG. 7, an alarm signal received at antenna 34 will be demodulated and amplified by the circuitry formed by NPN transistors 106 and 108. This signal is further amplified by operational amplifier 110 and amplifier 112. The output of amplifier 112 is applied to the input terminal 14 of a second digital oscillator 114 whose input terminals 2, 4, 6, 8 and 10 are connected to the positive terminal 98 via a plurality of single pole, single throw switches 115 and whose output terminal 13 is connected by a resistor 116 to the gate electrode of a semiconductor controlled rectifier (SCR) 118. The cathode of SCR 118 connects to ground while its anode connects to the cathode of a light emitting diode 120. The anode of diode 120 is connected to terminal 98 via a resistor 122. The junction 121 between diode 120 and SCR 118 is connected to a coil 124 of a relay 126. A diode 128 is connected across coil 124 with its cathode connected to the terminal 98 and its anode connected to the junction 121. This diode 128 prevents the energizing of coil 124 unless the SCR 118 is conductive. A second light emitting diode 130 is connected via a resistor 132 from the terminal 98 to ground. The receiver circuit has not been described in greater detail as it may be purchased from Multi-Elmac, a division of The Stanley Works, Novi, Mich. This circuit is commonly used in a garage door receiver.

Once the appropriate digitally coded signal is received by receiver circuit, 32 as established by the setting of the switches 115, the output of the digital oscillator 114 causes the SCR 118 to conduct for drawing current through coil 124 which closes a contact 134 of the relay 126. Closure of the normally opened contact 134 connects the terminal 100 to ground via a double pole, double throw switch 136 and terminal 102.

Figure 8:
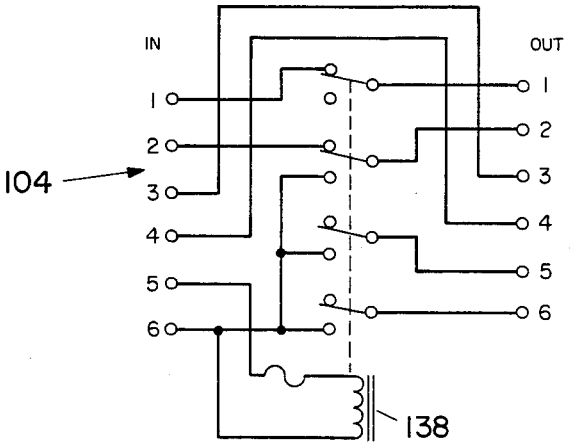
FIG. 8 is a schematic diagram of the power relay shown in FIG. 6.

As seen in FIGS. 6 and 8, connection of terminal 100 to ground connects terminal 5 of the power relay 104 to ground for energizing a solenoid switch 138 within the power relay 104, which is connected across the input terminals 5 and 6 thereof. The internal wiring of the power relay 104 connects output terminals 2, 5 and 6 to input terminal 6 and the positive terminal of battery 30 when relays 126 and 138 are energized. Any number of safety devices may be connected to the output of the power relay. As seen in FIG. 6, the output terminal 6 of relay 104 connects to the horn 37. If the liquid immersion alarm is being utilized in a power boat, it may be desirable to connect a fuel shutoff solenoid 140 to output terminal 5. It might also be desirable to connect a solenoid operated latch 142 to terminal output 5 wherein the activation of solenoid 142 would free a springloaded flotation device for ejection overboard, for example.

If the liquid immersion alarm were to be used in a sailboat, the power relay 104 can be connected to an auto-pilot control 144 by connecting the clockwise and counterclockwise rotation terminal to input terminals 1 and 2 of the power relay 104. Similarly, the power supply terminals from the auto-pilot control unit 144 are connected through input terminals 3 and 4 or power relay 104 to a helm drive unit 146. In this embodiment, receipt of an alarm signal at antenna 34 connects terminal 100 to ground for applying power through the solenoid coil 138 for energizing relay 104. As seen in FIG. 8, energization of relay 104 will not remove power from the helm drive 146 as the input terminals 3 and 4 of relay 104 are through connected to output terminals 3 and 4. However, input terminals 1 and 2 are affected as the output terminal 1 is disconnected and output terminal 2 is connected to the positive terminal of battery 30. If the auto-pilot control unit 144 were wired to apply a clockwise rotational signal to input terminal 2 and a counterclockwise rotational signal to input terminal 1, the disconnection of terminal 1 and connection of terminal 2 to the power supply would cause the sailboat in which the auto-pilot unit 144 was installed to turn in circles in a direction determined by the connection of the helm drive 146.

It will be seen from the foregoing desciption that the wearer of the transmitter 10 will cause an alarm signal to be generated after immersion in salt water, for example, for a predetermined time period. The alarm signal received by antenna 34 energizes the receiver 32 for applying power to the power relay 104 and activating the horn or siren 37 and other safety devices, such as fuel cutoff solenoid 140 and latching solenoid 142. After the transmitter has been immersed in salt water, it may be reset by depressing the reset button 92 which is described above in greater detail. The control panel of receiver 32 may include a power indicator provided by light emitting diode 130 and an alarm indicator provided by light emitting diode 120. To test the receiver, an operator would throw the double pole, double throw switch 136 to the test position and immerse the transmitter 10 in water. If the system were working properly, the SCR switch 118 would permit the flow of current through coil 124 for energizing LED 120 and indicating an alarm condition on the panel of the receiver 132. However, as the double pole, double throw switch 136 is in its test position to remove contact 134 from terminal 102, the receiver will not connect the solenoid coil 138 in power relay 104 to ground and will not energize the safety devices 37, 140 and 142.

Figure 9:
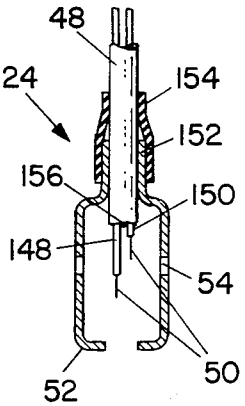
FIG. 9 is a partial, cross-sectional view of a liquid activated switch used in the present invention.

Referring now to FIG. 9, the liquid activated switch 24 is shown in greater detail. The flexible cable shield 48 contains two insulated wires 148 and 150 each having approximately one-fourth inch of insulation stripped away from its end to form contacts 50. Notice, that wire 148 is approximately one-fourth inch longer than wire 150 so that insulation one wire 148 will prevent the closure of contacts 50 should someone insert a sharp instrument into shield 52 to cause the wires to contact one another. The wire 148 is arranged with its insulation aligned with the lower portion of apertures 54, while the tip of wire 150 is aligned with this same elevation. This arrangement permits one contact 50 of wire 148 to be fully immersed in water before escaping air permits the immergence of the second contact of wire 150. In the preferred embodiment, the lower opening in shield 52 is approximately one-fourth inch while apertures 54 are one-eighth inch. The shield 52 has an upwardly extending collar 152 which receives the flexible cable 48 along its outer diameter. The inner end of cable 48 is sealed with epoxy 156, for example, to complete the assembly.

The present invention is intended for use by seaman and sailors to inform their shipmates that a man has fallen overboard. However, the alarm may be used in other situations to inform of its immersion in liquid, such as swimming pool water or mine water. Clearly, the device will not function if the liquid itself is not conductive. While other modifications and uses of the present invention are possible, the present invention should be limited only by the appended claims.

I claim:

1. A liquid immersion device adapted to be worn by a user and insensitive to the random presence of said liquid, comprising:

a battery power source having first and second terminals with said second terminal connected to ground;

a load device having an input terminal connected to said first terminal of said battery power source and a ground terminal;

a liquid activated switch having first and second terminals with said first terminal connected to said first terminal of said battery power source;

a delay circuit having first, second and third terminals, including:

said first terminal connected to said second terminal of said liquid activated device, said second terminal connected to said ground terminal of said load device and said third terminal connected to ground;

an electrically activated solid state flip flop switch having a set terminal;

electronic integrating accumulation circuit means for delaying the activation of said electrically activated solid state flip flop switch connected to said set terminal; and electronic integrating decumulation circuit means to control the accumulation of said first mentioned electronic integrating accumulation circuit means connected between said set terminal and ground;

said delay circuit thus connecting said second terminal of said battery power source to said ground terminal of said load through said delay circuit after said first and second terminals of said liquid activated device are immersed in liquid for a predetermined time period, whereby said timed immersion causes said battery power source to be connected to said load device to transmit an alarm signal.

2. A liquid immersion device, as claimed in claim 1, additionally comprising:

said load device is a radio transmitter sealed within a liquid tight container;

an antenna extended above said transmitter within said container; and said liquid activated switch extended below said transmitter to activate radio said transmitter into transmitting said alarm signal.

3. A liquid immersion device, as claimed in claim 2, additionally comprising:

an arm extended below said transmitter having an unsupported end;

a cylindrical shield mounted upon said unsupported end;

said switch including a pair of conductors extending along said arm and exposed at said unsupported end within said cylindrical shield.

4. A liquid immersion device, as claimed in claim 3, wherein:

said pair of conductors exposed at said unsupported end of said arm are exposed at two different lengths so that physical contact between said pair of conductors prevents electrical contact.

5. A liquid immersion device, as claimed in claim 3, additionally comprising:

said cylindrical shield having apertures therein above said exposed conductor pair to permit the escape of entrapped gases when said switch is immersed in liquid.

6. A liquid immersion device, as claimed in claim 5, wherein:

said exposed conductor pair includes one conductor exposed below said apertures and a second conductor exposed in alignment with said apertures.

7. A liquid immersion device, as claimed in claim 1, wherein:

said electronic integrating accumulation circuit means is a resistor-capacitor circuit; and said electronic integrating decumulation circuit means is a resistor having a resistance approximatley ten times greater than the resistance of said resistor-capacitor means.

8. A liquid immersion device, as claimed in claim 2, additionally comprising:

a second power source;

a radio receiver having an antenna for receiving said alarm signal;

relay means activated by said radio receiver upon receipt of said alarm signal; and safety means connected to said relay means to said second power source.

9. A liquid immersion device, as claimed in claim 8, wherein said safety means comprises:

a solenoid actuated fuel line shut-off valve.

10. A liquid immersion alarm, as claimed in claim 8, wherein said safety means comprises:

an audio alarm.

11. A liquid immersion device, as claimed in claim 9, wherein said safety means comprises:

a spring loaded mounting assembly for flotation equipment; and a solenoid actuated latch to release said spring mounted flotation equipment.

12. A liquid immersion device, as claimed in claim 8, additionally comprising:

power relay means connected to said relay means;

said power relay means having a plurality of input and output terminals;

said power relay means including a solenoid switch connected to two of said input terminals to be actuated by said first mentioned relay means which connects said second power source to said solenoid switch; and said solenoid switch connecting and disconnecting a selected number of input terminals to and from a selected number of output terminals, connecting said second power source to a selected number of output terminals, and retaining a selected number of input terminals connected to said output terminals.

13. A liquid immersion device, as claimed in claim 12, wherein said safety means comprises:

an autopilot with a servo drive mechanism which drives said autopilot between servo limits;

said power relay connected between said radio receiver and said autopilot wherein receipt of said alarm signal by said radio receiver actuated said relay means to actuate said power relays to connect said second power source to said autopilot to drive said autopilot to one of its servo limits.

14. A liquid immersion device, as claimed in claim 2, additionally comprising:

said liquid tight contained having a chamber therein into which said battery power source is inserted; and said chamber having sealing means for contacting said battery and sealing said container against leakage.

15. A liquid immersion device, as claimed in claim 1, wherein said delay circuit further includes:

latch means for permanently connecting said power source to said load device after said delay of said activation; and reset means for manually disconnecting said power source from said load device.

* * * * *